United States Patent [19]

Stahlecker et al.

[11] 4,125,989

[45] Nov. 21, 1978

[54] METHOD AND APPARATUS FOR TREATMENT OF PIECED PLACES IN A YARN

[76] Inventors: Fritz Stahlecker, Josef-Neidhart-Str. 18, 7341 Bad Überkingen; Hans Stahlecker, Haldenstrasse 20, 7334 Süssen, both of Germany

[21] Appl. No.: 792,582

[22] Filed: May 2, 1977

[30] Foreign Application Priority Data

May 11, 1976 [DE] Fed. Rep. of Germany ..... 2620811

[51] Int. Cl.[2] ..... D01H 15/00

[52] U.S. Cl. ..... 57/263; 57/334

[58] Field of Search ..... 57/22, 23, 34 R, 159; 28/209, 210, 211

[56] References Cited

U.S. PATENT DOCUMENTS

| | | | |
|---|---|---|---|
| 2,499,349 | 9/1948 | Waugh et al. | 57/22 X |
| 3,633,352 | 1/1972 | Marriner | 57/22 |
| 3,925,975 | 12/1975 | Stahlecker et al. | 57/34 R |
| 3,987,610 | 10/1976 | Stahlecker et al. | 57/80 X |

*Primary Examiner*—Donald Watkins

*Attorney, Agent, or Firm*—Craig & Antonelli

[57] ABSTRACT

A method and apparatus is provided for treating pieced places in yarn produced on open end spinning machines. The pieced places are treated by mechanically compacting the same during drawing off of the yarn from a spinning machine after a piecing operation. Various embodiments are disclosed for carrying out this mechanical compacting, including retractable fingers, rollers, and belts, which operate together to press the piece places and compact the same during drawing-off of the yarn from the spinning assembly. In preferred embodiments, the apparatus for compacting the pieced places is carried on a mobile servicing device.

33 Claims, 22 Drawing Figures

METHOD AND APPARATUS FOR TREATMENT OF PIECED PLACES IN A YARN

BACKGROUND AND SUMMARY OF THE INVENTION

The invention relates to a method and a device for treatment of the pieced places of a yarn, particularly pieced places in a yarn produced on open end spinning machines, during the drawing off of the yarn from a spinning assembly and before winding on a spool.

There are practically always some pieced places in the yarn on a spool from an open end spinning assembly. These pieced places occur if a yarn break has to be accommodated. It is to be understood that yarn breaks and the projections that result are caused not only by operational disturbances, but also they are many times intentionally produced to maintain a specific yarn quality over a rather long operational time. These pieced places have a strength and appearance that differs from that of the rest of the yarn. To prevent possible flaws in the fabric or the like in material made of the yarn, it used to be customary to clean the spools produced in open end spinning assemblies. Meanwhile however it has been possible to improve the piecing process so that the pieced places have sufficient strength. Cutting out of these pieced places is therefore no longer necessary, especially since the knots produced after the cutting out operation were at least as disturbing in the product made from the yarn as the pieced places were.

The invention is addressed to the problem of treating the pieced places even before winding of the produced yarn on the spools, in such a way that their appearance will be much more closely adapted to the appearance of the rest of the yarn and not show up as thickened places. The problem is solved according to the present invention in that the pieced places are mechanically compacted during the drawing off operation.

By this mechanical compacting, which is limited to the zone of the pieced place, the pieced place which looks more bulky than the rest of the yarn will be equalized with said yarn.

In an advantageous embodiment of the invention it is provided that the pieced places are compressed by pressure elements and rolled about the long axis of the yarn. In this way the yarn in the zone of the pieced places will be rubbed, which will effect a very good equalizing of the pieced places. It is advantageous if at least the beginning of the rolling movement be in the same direction as the spinning part of the yarn. In that way the yarn will not be turned against its twist.

In order to have enough time for the rubbing or the like, it is provided in a further embodiment of the invention that the pressure elements will be capable of being brought up to the running yarn and move during the treatment of the pieced place in the direction of transport of the yarn. For the same purpose, in another embodiment of the invention, it is provided that the pieced places during execution of the treatment will be held by fixedly disposed pressure elements, with production and/or elimination of a yarn reserve.

In a further embodiment of the invention, it is provided that the pieced places will be wetted with a strengthening agent before the mechanical compacting. This strengthening agent, which may comprise a material that can be washed out in a subsequent treatment step, is intended to hold the pieced places in the form given them by the mechanical compacting.

In a further embodiment of the invention, a device for execution of the process is produced, in that pressure elements associated with the yarn are provided, equipped with drive means that can be switched on by controls as a pieced place passes by. More advantageously, the pressure elements have drive and control devices that are components of a travelling piecing device. Of course, it is contemplated to provide pressure elements and the appurtenant drive and control devices on each spinning assembly, but this entails considerably more expense.

These and other objects, features and advantages of the present invention will become more apparent from the following description when taken in connection with the accompanying drawings, which show, for purposes of illustration only, several embodiments in accordance with the present invention.

DETAILED DESCRIPTION OF THE DRAWINGS

Figure 1:
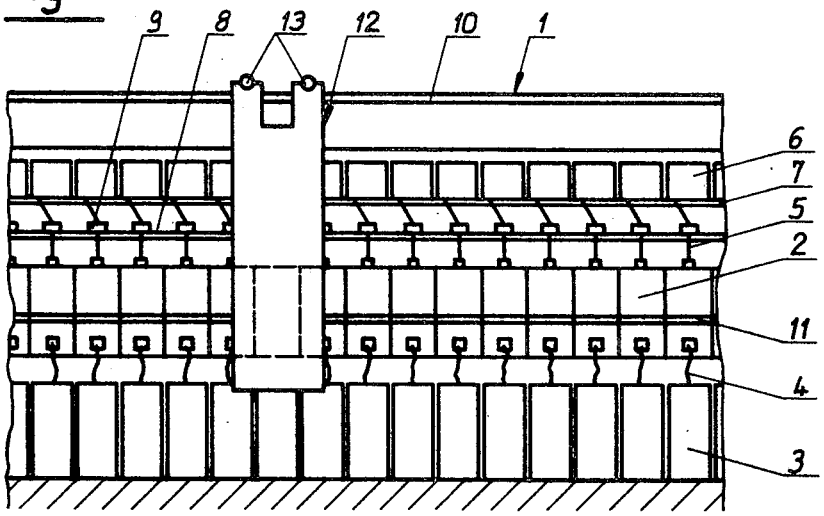
FIG. 1 is a schematic front view of a part of an open end spinning machine with a travelling servicing device constructed in accordance with the present invention.

In FIG. 1 a portion of a front side of an open end spinning machine 1 is shown schematically, said machine comprising a plurality of open end spinning assemblies 2 arranged side by side. Each spinning assembly 2 is fed a sliver 4 from a can 3, which sliver is opened in a known way inside spinning assembly 2 to individual filaments, spun and subsequently drawn off by means of draw rolls 8, 9 in the form of yarn 5, said yarn 5 being wound on a winding spool 6 that is driven by a friction roll 7. A mobile piecing device 12 can be moved along the open end spinning machine 1 on rails 10 and 11, the device having rollers 13 that are merely schematically indicated.

The open end spinning assembly 2 (FIG. 2) has a housing 14 that contains a spinning rotor 15 whose shaft 16 is driven and borne in a way that is not shown in detail, since the same should be well known to skilled artisans. On a further stationary part housing 17 there is a shaft 18 about which a housing part 19 can be swung, said part 19 in addition to the feed and opening assemblies, containing a yarn takeoff passage 20 from which the spun yarn 5, indicated by dot-and-dash lines, can be drawn off during the spinning process. A yarn monitor 21 is also provided on open end spinning assembly 2, as well as takeoff rolls 8 and 9, a yarn deflector guide 22, a yarn change guide 23, and friction roll 7 on which winding spool 6 is applied during the spinning process and is driven thereby. In the illustrated example, winding spool 6, which is held by a spool holder 24 that is swingable about a shaft 25 fixed on the machine, is also lifted off from friction roll 7 during the piecing process. The lifting off of winding spool 6 is effected by means of a lift-off roll 26 disposed on a travelling piecing device 12; said roll 26, fixed on a swing arm 27, can be driven in both directions of rotation. During the piecing process, yarn 30, which is to be carried back into the yarn takeoff passage 20 and pieced, is guided by a pair of auxiliary takeoff rolls 28, 29 of the travelling piecing device 12, whereby the direction of rotation of takeoff rolls 28, 29 can be controlled by an intermediately connected tension sensor 31. The actual devices for piecing yarn 30 are not shown in FIG. 2 in order not to obscure the present invention and since such are known in the state of the art. In the operating position shown in FIG. 2, the piecing process is already completed. Yarn 30 has already been taken again from takeoff passage 20 and delivered to winding spool 6 which is driven during this process by liftoff roll 26. The pieced place, i.e. the end of yarn 30 that has been carried back, is bound into the filaments that are in the spinning rotor 15 and is now treated by means still to be described, whereafter yarn 30 is transferred to the dot-and-dash position 5 on the spinning assembly 2.

A rubbing device 32 is provided for the treatment, strengthening and equalizing of the pieced place. Device 32 comprises a yarn clamping device 33 whereof the clamping jaws that are described in later figures move in the direction of the double arrows, hence crosswise to the yarn. Said clamping device 33 is opened with parts thereof spaced from yarn 30 during the piecing process and is only brought briefly into action when a pieced place passes the zone of clamping device 33. The existence and position of a pieced place can be determined in various ways. It is contemplated to control the switching in of the clamping device drive with the program control of the piecing device since the pieced place reaches the clamping device after a predetermined time after pulling off of the yarn is triggered again. However, it is also contemplated to determine the pieced place by means of an optical or electrical sensor, for example in the region of tension sensor 31 and to control the mechanical compacting of the pieced place in response to detection by such sensor. Since such sensors, per se, are known, details thereof are not included herein so as not to obscure the invention.

The pieced place undergoes multilateral pressing from the "rubbing" motion (described more fully below for the various preferred embodiments), whereby the desired compacting effect is produced. The clamping device is disposed swingably on a shaft 34 and, as indicated by double arrow 35, it can be driven in the direction of the running of the yarn, advantageously at a rate corresponding to the yarn takeoff speed, so that there is a fairly long interval available for the rubbing motion. A motor 36 is schematically indicated as drive for the rubbing device 32.

Figure 2:
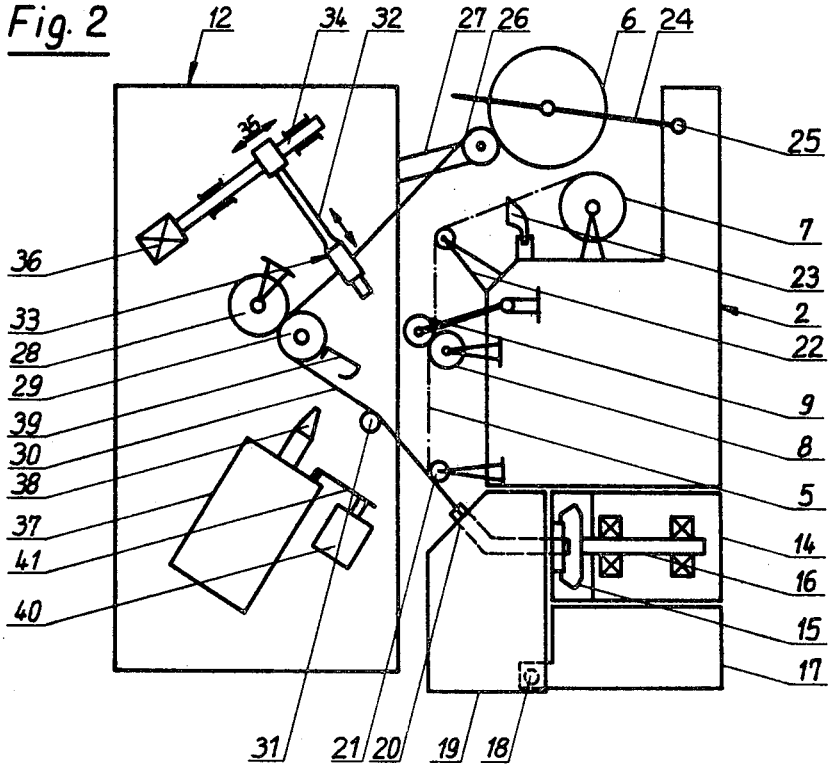
FIG. 2 is a cross sectional view through a spinning assembly of the open end spinning machine of FIG. 1 and through the servicing device.

In the embodiment of FIG. 2 there is also a spray receptacle 37 which is actuated, via a coupling member 41 of a control means 40, for spraying a strengthening agent, e.g. adhesive or the like, onto pieced yarn 30 at the moment at which the pieced place passes the zone of its spray nozzle 38. A collecting sheet 39 is indicated, for catching the strengthening agent which is advantageously liquid. Activation of this spraying mechanism is controlled either in response to detection of the pieced place by an electrical sensor or by a predetermined delay from the initiation of the drawing off operation during piecing.

Figure 3:
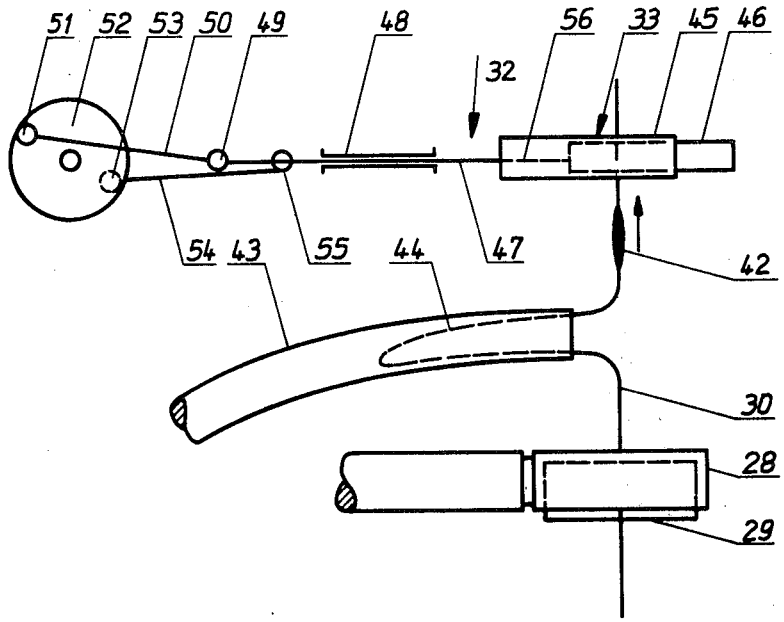
FIG. 3 is a schematic view of a detail of the servicing unit of FIG. 2.

In order to have sufficient time for the treatment of the pieced place 42 (FIG. 3), a yarn reserve 44 is produced between rubbing device 32 and the pair of auxiliary draw off rolls 28, 29, by means of a suction nozzle 43. Suction nozzle 43 is connected to a vacuum source in a way that is not shown in detail, whereby switching elements such as valves or the like are provided for applying a vacuum to the suction nozzle as a function of the appearance of a pieced place 42, in response to control apparatus, such as the control apparatus for driving rubbing device 32. Since the vacuum connection and control apparatus could be readily constructed by those skilled in the art, given the state of the art and the present disclosure, further details are dispensed with herein so as not to obscure the invention.

The pieced place 42 moves relatively slowly in the region of the rubbing device 32, the speed of place 42 being controlled by a suitable switching of the lift off roll drive (lift off roll 26). Yarn 30 is taken off at an unslackened speed by the auxiliary take off rolls so that then a yarn reserve 44 is formed which, after pieced place 42 has passed through rubbing device 32 is again eliminated by a faster driving of the lift off roll 26. To switch over the drive of lift off roll 26 and switch in the suction on nozzle 43, these operations are preferably established by the program of piecing device 12. Alternatively, these operations can be controlled as a function of a device that engages and detects the piecing place 42.

Figure 5:
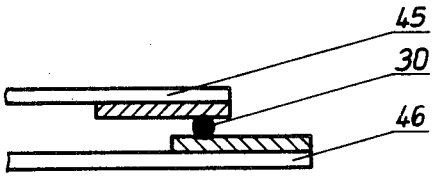
Figure 6:
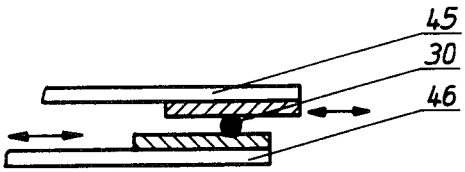

Clamping device 33 of the rubbing device 32 has two jaws 45 and 46 which can be driven counter to movements transverse to the yarn axis 30 (toward one another in a direction transverse to the yarn axis). These jaws 45 and 46 are in a zone through which yarn 30 normally passes, without having the yarn touch the jaws. Jaws 45 and 46 are only moved toward each other to execute the rubbing motion, in such a way that they tension the yarn between them, in the zone of piecing place 42 (FIG. 5). Thereafter, they are thrust counter to each other so that pieced place 42 is rubbed or rolled between the two jaws. If both jaws 45 and 46 are driven uniformly, this offers the advantage that the yarn or the pieced place 42 is not deflected. By the rolling or rubbing of yarn 30 or of pieced place 42, the pieced place 42 is pressed on all sides and compacted so that, strengthened in its configuration and periphery, it is adapted to the other zones of the yarn 30. Here it is advantageous that the rolling motion occurs at least at the beginning in the direction of the spinning twist of the yarn, so that the yarn, in the zone of pieced place 42, will be strongly twisted together. It is contemplated in certain embodiments to drive the two jaws 45 and 46 in reciprocating motions so that then the rotation that is supplementarily imparted to the yarn will again reverse. It is useful in this case also, however, to have a reciprocating motion occur in the direction of the spinning twist in the first rolling motion of the pieced place.

Figure 4:
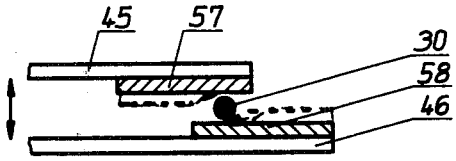
FIGS. 4–6 are schematic views of pressure elements of the embodiment as in FIG. 3, in various operating positions.

Jaws 45 and 46 are furnished with suitable coatings 57 and 58 whereby the pieced place will be well engaged and turned and sliding of the pieced place on one of the jaws will be prevented. It is advantageous to have relatively soft coverings 57 and 58 that have a high coefficient of friction. As indicated in dashed lines in FIG. 4, the friction coatings 57 and 58, and or also the jaws 45 and 46 that support them, have a suitable configuration whereby the nip between them narrows with a counter sliding of jaws 45 and 46, so that there is no need for a supplementary drive that sets jaws 45 and 46 perpendicularly to their clamping surfaces.

Jaws 45 and 46 are preferably driven in counter or reciprocating motion by a crank drive. For this purpose they are connected via thrust rods 47 and 56 guided in a slide guide 48 to articulations 49 and 55 of connecting rods 50 and 54 that are articulated on crank pins 51 and 53 of a crank plate 52.

It is also contemplated in certain embodiments to execute the rubbing movement by means of auxiliary take off rolls 28 and 29 of the travelling piecing device. In this case there is provided a supplementary drive for the undriven auxiliary take off roll 28 which can move said roll 28 axially. In most cases, however, it is advantageous if special devices separate from rolls 28, 29 are provided for the compacting of pieced places 42 of yarn 30.

Figure 7:
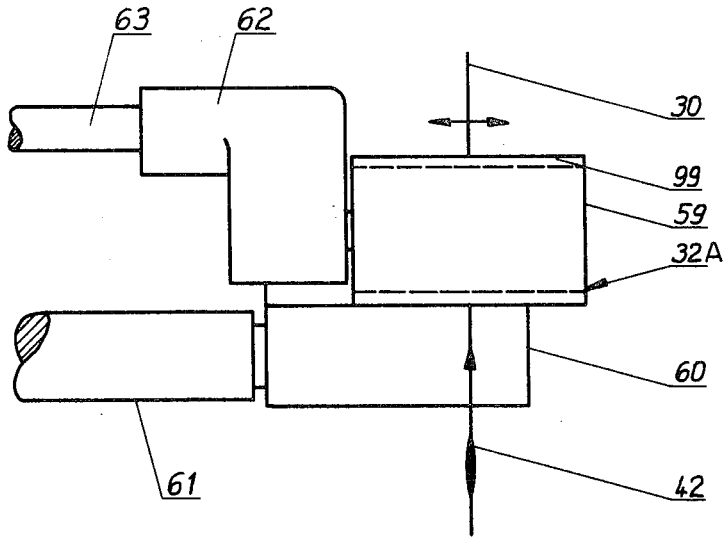
FIG. 7 is a schematic view of a detail of the servicing unit constructed in accordance with another embodiment of the device of the invention with a changing roll.

In the embodiment of FIG. 7 a rubbing device 32A is provided which is formed by two adjacent rolls 59 and 60 between which the yarn 30 is passed. Both rolls 59 and 60 have special coverings whereby in particular roll 59, which can be reciprocatingly driven, has a special soft cover 99. Roll 59 is borne on a bent arm 62 that is swingable about a shaft 63 in such a way that the nip between the two rolls 59 and 60 can be removed or produced as needed. In order to avoid influence on the yarn from increased tension or the like, it is advantageous if roll 60 is driven by means of a shaft 61 in the direction of transport of yarn 30.

Figure 8:
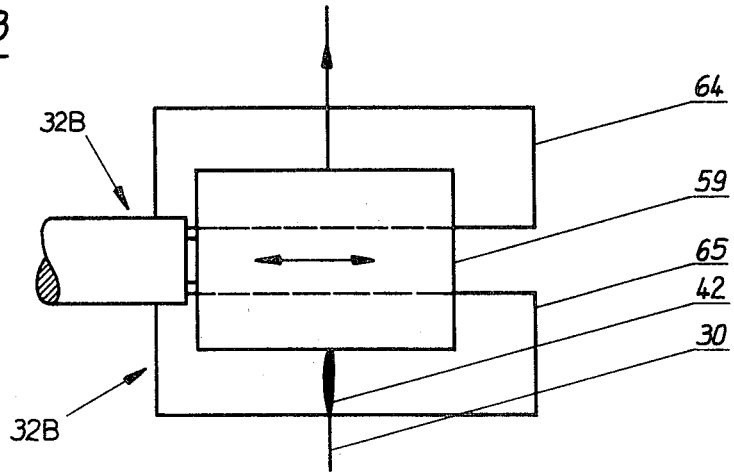
FIGS. 8 and 9 are respective side and sectional schematic views which show an embodiment similar to that of FIG. 7, but with a changing roll and two lower rolls.
Figure 9:
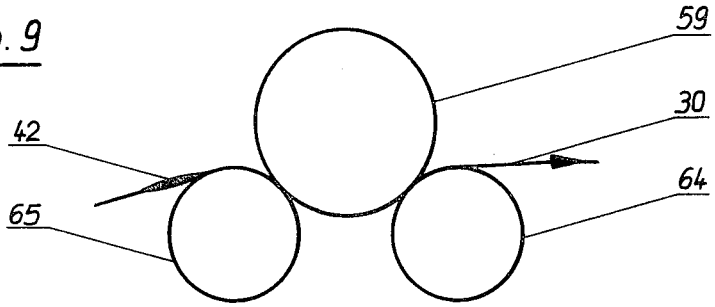

In the embodiment of FIGS. 8 and 9, rubbing device 32B includes a roll 59 which is axially movable and which can be swung and axially reciprocatingly borne as in the embodiment of FIG. 7. In addition to roll 59, there are two associated rolls 64 and 65, whereof advantageously at least one is driven. By this arrangement, there are two rubbing treatments in the area of the pieced place, whereby the rubbing is not restricted to the area just in the immediate vicinity of the pieced place, so that there is a more gradual transition between the rubbed and unrubbed areas.

Figure 10:
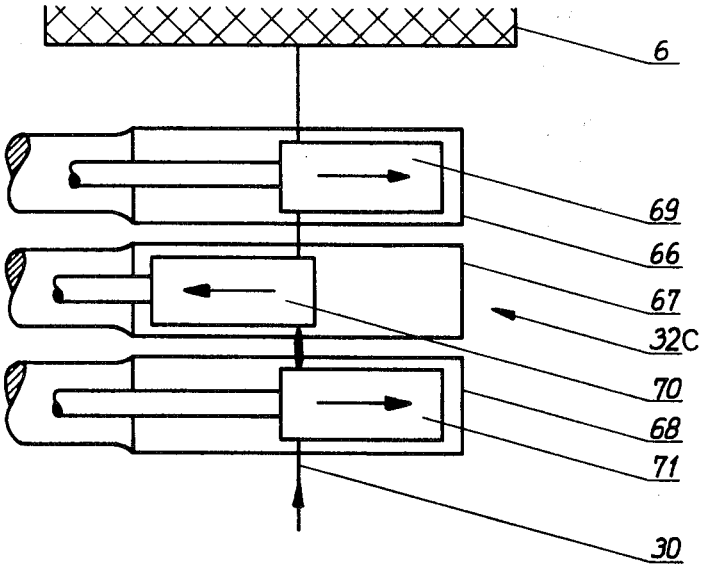
FIG. 10 is a schematic view of a detail of the servicing unit constructed in accordance with an embodiment with several reciprocatingly movable pressure elements.

Similarly, in the embodiment of FIG. 10, rubbing device 32C is provided wherein pieced place 42 of yarn 30 and the yarn area upstream and downstream undergo three rubbing processes. For this there are three pairs of rolls 66 and 69, 67 and 70, as well as 68 and 71, whereof the respective lower rolls 66, 67 and 68 are driven while upper rolls 69, 70 and 71 run free and can be moved reciprocatingly in an axial direction. Here it is provided that middle roll 70 will be driven in opposition to the two outer rolls 69 and 71, so that between the nips of the paired rolls there will be a kind of false twist action on yarn 30 and especially on pieced place 42.

Figure 11:
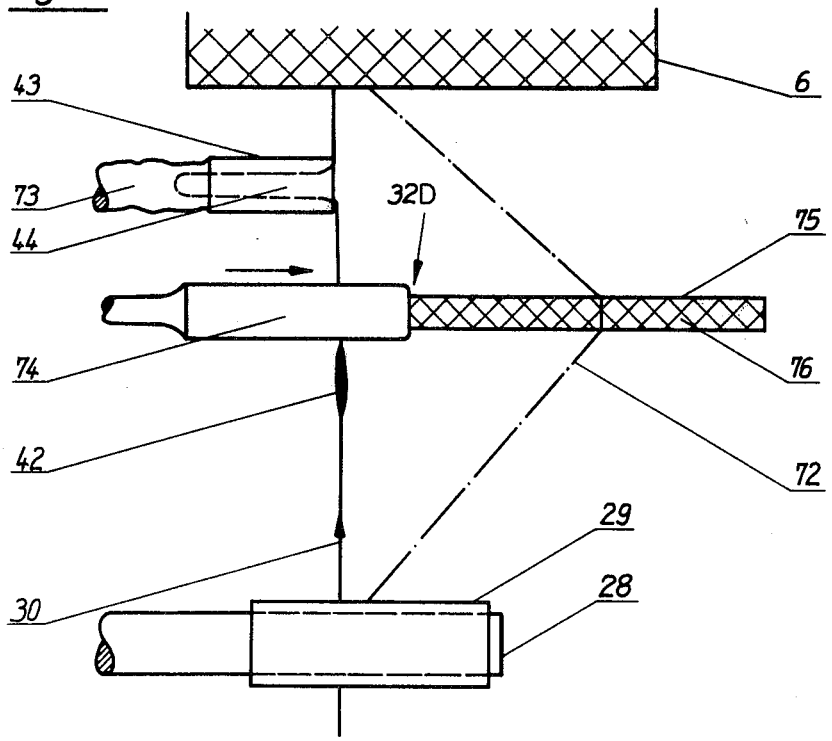
FIG. 11 is a schematic view of a detail of the servicing unit constructed in accordance with yet another embodiment which is somewhat similar to the FIG. 3 embodiment.

In the embodiment of FIG. 11, the rubbing device 32D comprises a stationary pressure surface 75 and a reciprocatingly driven rubbing finger 74, crosswise to the axis of yarn 30, which finger 74 can be adjusted in a way that is not shown in detail, vertically with reference to the plane of the drawing of pressure surface 75. Pressure surface 75 has a crossed corrugation 76 to exert adequate friction. Rubbing finger 74 can be provided in a way not shown in detail with a suitable friction covering, whereby in some situations the friction covering or the finger 74 can be of such configuration that with the thrusting motion the distance to clamping surface 76 is reduced, so that there is no need for a special setting of the clamping device (for example the friction covering in finger 74 can be tapered from a smaller cross-section at the end to a larger cross-section in the lefthand direction of FIG. 11). The thrust motion of rubbing finger 74 deflects yarn 30 into the position 72 which is indicated in dot-and-dash lines. To make this deflection possible, there is advantageously a suction nozzle 43 disposed between rubbing device 32D and spool 6, which is connected by a flexible conduit 73 to a vacuum source, and that produces a yarn reserve 44 (Also see description related to the FIG. 3 embodiment). In this embodiment it may be provided that the rubbing finger 74 will be guided in a guide whereby it is associated at the start with clamping surface 75 and at the end of the thrust movement it will be lifted off the clamping surface 75, so that yarn 30 will be rolled only in the direction toward the dot-and-dashed position of the yarn 72 and automatically will return to the other position.

Figure 12:
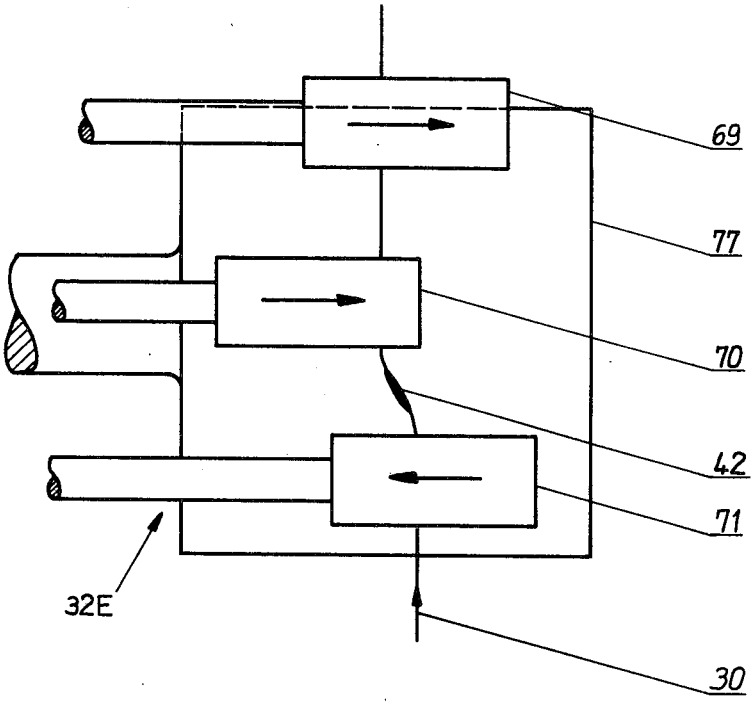
FIGS. 12 and 13 are respective side and sectional schematic views which show an embodiment with three reciprocatingly movable pressure elements and a common lower roll.
Figure 13:
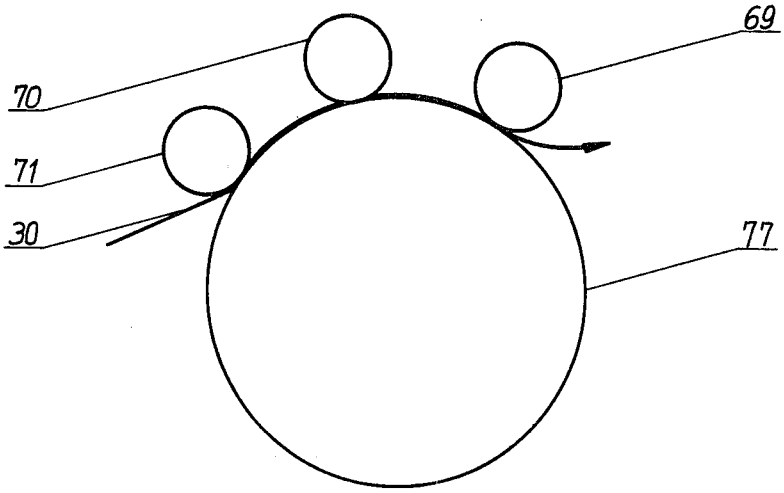

The embodiment of FIGS. 12 and 13 corresponds functionally essentially to the embodiment of FIG. 10. In this embodiment rubbing device 32E is provided wherein lower rolls 66, 67 and 68 (of the FIG. 10 embodiment) are replaced by a single driven lower roll 77 whose diameter is big enough so that the rolls 69, 70 and 71, which are axially driven in reciprocating motions, will have enough room at their periphery, and the distance between rolls 69, 70 and 71 will advantageously be such, that the thickening of pieced place 42 that usually is produced in piecing can lie freely between rolls 69 and 70 and 71, respectively, as shown.

Figure 14:
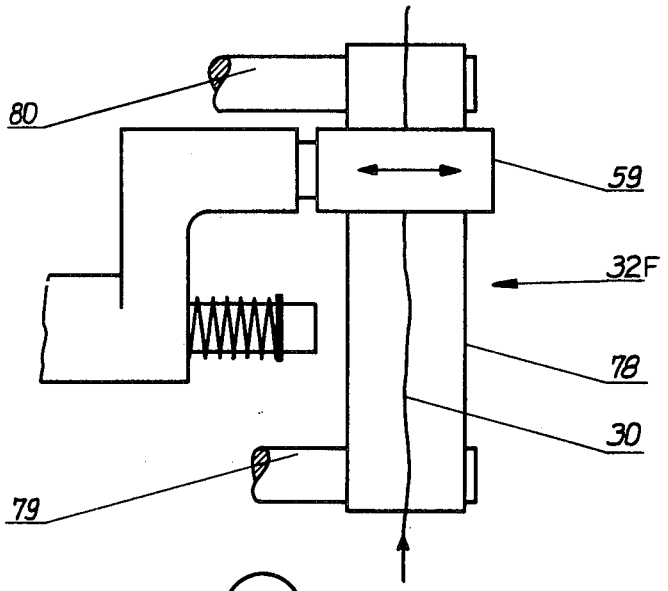
FIGS. 14 and 15 are respective side and sectional schematic views which show an embodiment of pressure elements with a reciprocating roll and a belt guide.
Figure 15:
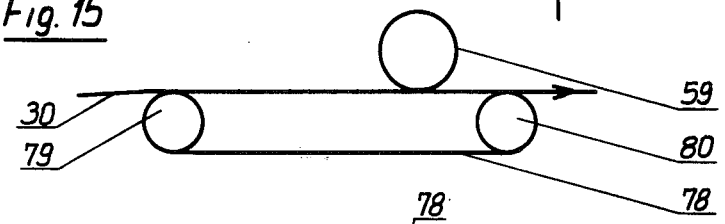

The rubbing device 32F of the embodiment of FIGS. 14 and 15 corresponds generally in its function to the embodiment of FIG. 7. In this embodiment, however, the lower roll is replaced by a belt 78 against which roll 59 is lightly pressed so that thereby the pieced place 42 will be simultaneously engaged and rolled in its entire length during the rubbing movement. Belt 78 is advantageously driven in the transport direction of the yarn, for which purpose a drive roll 80 and a deflector roll 79 are provided. Belt 78 may also be made of a soft material that has a high coefficient of friction.

Figure 16:
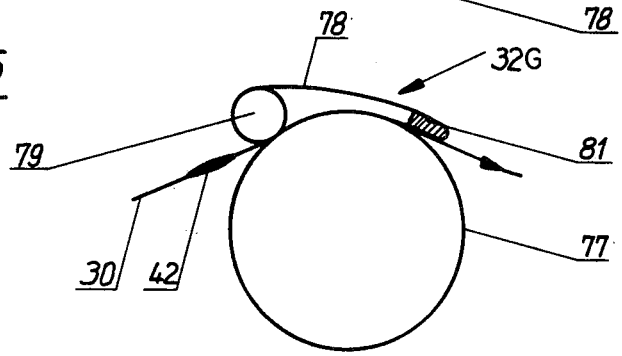
FIG. 16 is a schematic view which shows an embodiment of pressure elements with a lower roll and a changing belt guide.

In the embodiment of FIG. 16 there is a rubbing device 32G that is constituted by a roll 77 with a relatively large diameter and a belt 78. Belt 78 is guided with a deflector roll 79 and a deflector rail 81 in such a way that it is applied over a relatively large periphery on driven roll 77. Belt 78 can be guided in a way that is not illustrated in detail together with deflector roll 79 and deflector rail 81 axially to roll 77, to execute a rubbing movement. With this embodiment also a relatively great length of yarn 30 or the zone of pieced place 42 is engaged in the rubbing guide, said pieced place then being rolled or rubbed.

Figure 17:
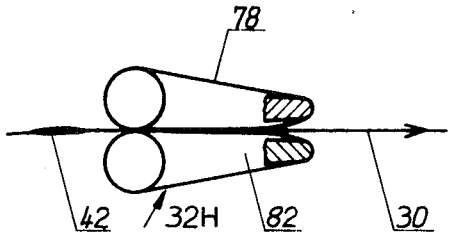
FIG. 17 is a schematic view which shows an embodiment with two pressure elements made as belt guides.

The rubbing device 32H of the embodiment of FIG. 17 has two belts 78 and 82 with corresponding guides, whereof at least one is driven in the direction of transport of the yarn 30. The other is advantageously provided with a drive that is not illustrated, whereby it can be moved crosswise to the long axis of yarn 30, so that yarn 30 and especially pieced place 42 will be rolled about the long axis, to get a rubbing movement.

Figure 18:
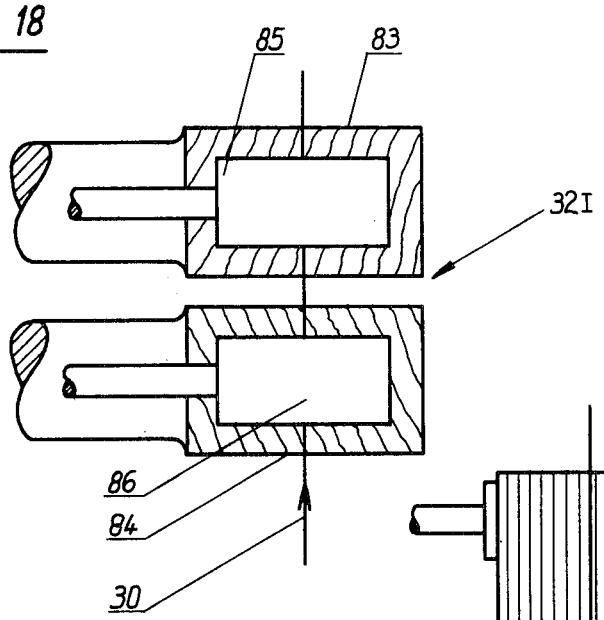
FIG. 18 is a schematic view which shows an embodiment of pressure elements which act on the yarn or on the pieced place that is to be treated, at a slant with reference to the direction of transport.

Rubbing device 32I of FIG. 18 has two lower rolls 83 and 84, disposed one behind the other, to which respectively upper roll 85 and 86 are associated. Lower rolls 83 and 84 are advantageously driven. To get a rubbing movement with this form of embodiment it is provided that lower rolls 83 and 84 will have a helicoidal grooving whereby lower rolls 83 and 84 receive a direction of transport that is slanted with reference to the normal direction of transport of the yarn. Here it is advantageously provided that the corrugtion of lower rolls 83 and 84 which run in the same direction will be in reverse so that in the zone between the rolls a false twist action will be exerted on yarn 30 or on pieced place 42. Such an embodiment is technically simpler to achieve because it is possible to do without a reciprocating axially directed drive for a part that is in rotation.

Figure 19:
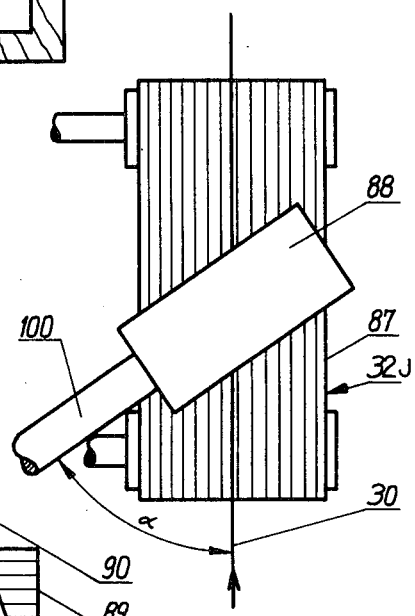
FIG. 19 is a schematic view which shows an embodiment with a slantedly set roll and a belt guide as pressure elements.

Also in the embodiment according to FIG. 19 it is possible to do without an axially reciprocating drive. In the rubbing device 32J shown in FIG. 19 there is a belt 87 that is arranged in the transport direction of yarn 30. This belt, guided about deflector rolls, whereof at least one advantageously is driven, has a roll 88 associted with it, whose shaft 100 is set at a sharp angle $\alpha$ with respect to the direction of yarn 30 or its long axis. In this embodiment it is provided that belt 87 will have a lengthwise shaping, strongly to oppose lateral shifting of the yarn and thereby to enhance the rubbing effect.

Figure 20:
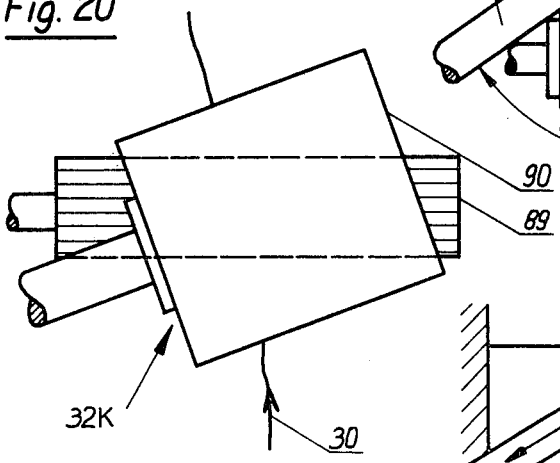
FIG. 20 is a schematic view which shows an embodiment similar to that of FIG. 19, but comprising two rolls.

The rubbing device 32K of the embodiment of FIG. 20 corresponds in principle to the embodiment of FIG. 19, whereby belt 87 is replaced by a grooved roll 89, associated with a roll 90 which is somewhat larger in cross section, disposed at a slant of angle $\alpha$ with reference to the running direction of the yarn, and which provides the rubbing effect. In the embodiments of FIGS. 18 to 20, it is advantageously provided that at least the parts that cause the transport acting slantedly on the direction of yarn transport or the yarn axis is driven. Advantageously, however all rolls or belts are driven. Obviously, in these embodiments also care is taken so that the nips between the rolls or between the rolls and the belt will be there only during the passage of pieced place 42 in the yarn.

Figure 21:
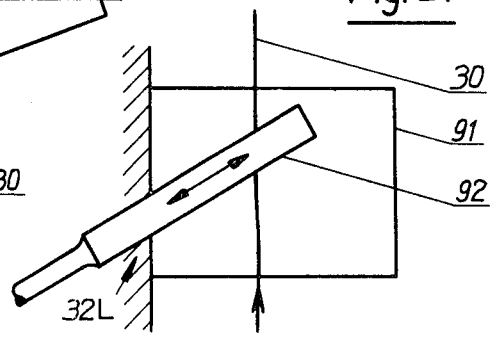
FIG. 21 is a schematic view which shows an embodiment with a movable rubbing finger that is at a slant with reference to the direction of the transport of the yarn and of the pieced places.

In FIG. 21 an embodiment of a rubbing device 32L similar to that of FIG. 11 is shown, in which a fixed pressure surface 91 is provided, to which a rubbing finger 92 is associated, which is disposed at a slant with reference to the long axis of the yarn 30 and driven in this direction to changing movements. In this embodiment the deflection of yarn 30 shown in FIG. 11 can be less.

Figure 22:
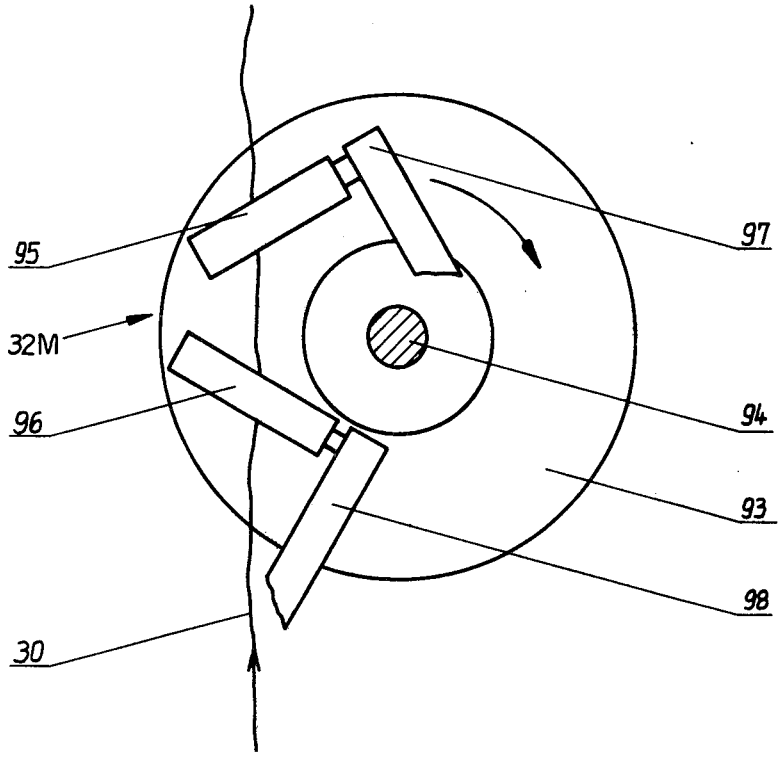
FIG. 22 is a schematic view which shows an embodiment with pressure element comprising a rotating disk and two rolls.

In the embodiment of FIG. 22 the rubbing device 32M comprises a plate rotating about a shaft 94, to which two rolls 95 and 96 on arms 97 and 98 are associated, which form a nip for yarn 30 together with a front surface of plate 93. Yarn 30 is guided in the form of a secant over the front surface of plate 93. Rolls 95 and 96 are set with respect to the direction of the yarn in such a way that they execute a rubbing motion. In this embodiment also it is advantageous if not only plate 93 but also roll 95 is driven, where attention is to be directed to having a common main direction of transport.

The rubbing of the pieced place exerts a kind of ironing action on the yarn which of course is dependent upon the pressure that is applied. In some situations it is advantageous if the rubbing is also done at elevated temperature, for example by having the parts that do the rubbing heated electrically. The rubbing is advantageously done with high frequency so that the work rate will not suffer. In some situations it is also advantageous for the sought for effect if yarn tension is varied, particularly reduced, during the rubbing.

Details of the mechanism for applying motive forces to the rubbing devices 32–32M, to effect the described movements, are not included herein in order not to obscure what applicants' consider is their invention. Since those skilled in the art should readily be able to construct such mechanisms using the present disclosure and the state of the art, further details are unnecessary. For example, known electric motors, coupled with gear drives, cam connections, and the like, could be utilized in constructing working embodiments based on the present disclosure.

While we have shown and described only several embodiments in accordance with the present invention, it is understood that the same is not limited thereto but is susceptible of numerous changes and modifications as would be known to those skilled in the art, given the present disclosure, we therefore do not wish to be limited to the details shown and described herein but intend to cover all such changes and modifications as are encompassed by the scope of the appended claims.

We claim:

1. Process for treating pieced places in yarn, especially the pieced places of yarn produced on open end spinning machines, comprising:

forming a pieced place in a yarn by joining a yarn end with a fiber ring in an open-end spinning rotor of a spinning assembly, drawing off of the yarn with the pieced place from the spinning assembly, and compacting the already formed pieced place by mechanical means during said drawing off at a position spaced from the spinning rotor.

2. Process according to claim 1, further comprising winding said yarn on a spool at a position downstream of said compacting, wherein said compacting includes compressing the pieced places between pressure elements that are selectively engageable with the yarn.

3. Process according to claim 2, wherein said compressing is accompanied by rolling of the yarn around its longitudinal axis.

4. Process for treating pieced places in yarn, especially the pieced places of yarn produced on open end spinning machines, comprising:

drawing off yarn from a spinning assembly, compacting the pieced places by mechanical means during said drawing off, winding said yarn on a spool at a position downstream of said compacting, wherein said compacting includes compressing the pieced places between pressure elements that are selectively engageable with the yarn, wherein said compressing is accompanied by rolling of the yarn around its longitudinal axis, and wherein at least initial portions of said rolling movement are in the same direction as the spinning twist of the yarn.

5. Process according to claim 3, wherein said rolling includes rolling the pieced places back and forth between the pressure elements.

6. Process according to claim 4, wherein said rolling includes rolling the pieced places back and forth between the pressure elements.

7. Process for treating pieced places in yarn, especially the pieced places of yarn produced on open end spinning machines, comprising:

drawing off yarn from a spinning assembly, compacting the pieced places by mechanical means during said drawing off, winding said yarn on a spool at a position downstream of said compacting, wherein said compacting includes compressing the pieced places between pressure elements that are selectively engageable with the yarn, and wherein said compacting includes moving of the pressure elements in the direction of transport of the yarn during said compressing.

8. Process for treating pieced places in yarn, especially the pieced places of yarn produced on open end spinning machines, comprising:

drawing off yarn from a spinning assembly, compacting the pieced places by mechanical means during said drawing off, winding said yarn on a spool at a position downstream of said compacting, wherein said compacting includes compressing the pieced places between pressure elements that are selectively engageable with the yarn, wherein said compressing is accompanied by rolling of the yarn around its longitudinal axis, and wherein said compacting includes moving of the pressure elements in the direction of transport of the yarn during said compressing.

9. Process according to claim 6, wherein said compacting includes moving of the pressure elements in the direction of transport of the yarn during said compressing.

10. Process according to claim 2, wherein the pieced places are held during compressing with fixedly disposed pressure elements by the production and subsequent elimination of a yarn reserve.

11. Process according to claim 3, wherein the pieced places are held during compressing with fixedly disposed pressure elements by the production and subsequent elimination of a yarn reserve.

12. Process according to claim 1, wherein the pieced places are wetted with a strengthening agent before the mechanical compacting.

13. Process according to claim 2, wherein the pieced places are wetted with a strengthening agent before the mechanical compacting.

14. Process according to claim 9, wherein the pieced places are wetted with a strengthening agent before the mechanical compacting.

15. Apparatus for treating pieced places in a yarn, especially the pieced places of yarn produced on open end spinning machines, comprising:

drawing means for drawing off yarn from a spinning assembly, and mechanical compacting means for compacting the pieced places during drawing off of yarn from the spinning assembly.

16. Apparatus according to claim 15, further comprising winding means for winding said yarn on a spool, wherein said mechanical compacting means are disposed to engage said yarn intermediate the spinning assembly and the winding means.

17. Apparatus according to claim 15, wherein said compacting means includes pressure elements selectively engageable with the yarn for compressing said pieced places, and wherein drive means are provided for drivingly moving said pressure elements during compressing of said pieced places.

18. Apparatus according to claim 17, wherein control means are provided for controlling actuation of said pressure elements upon passage of a pieced place in said yarn.

19. Apparatus according to claim 18, wherein said pressure means, drive means, and pressure elements are mounted on a travelling maintenance device which is selectively movable to respective spinning units of said spinning machine.

20. Apparatus according to claim 17, wherein the pressure elements are held with an adjusting device that can be driven in a motion in the direction of transport of the yarn by means of a drive mechanism.

21. Apparatus according to claim 19, wherein the pressure elements are held with an adjusting device that can be driven in a motion in the direction of transport of the yarn by means of a drive mechanism.

22. Apparatus according to claim 17, wherein there is a suction device disposed upstream of the pressure elements that produces a yarn reserve for accommodating the compacting of said pieced places.

23. Apparatus according to claim 19, wherein there is a suction device disposed upstream of the pressure elements that produces a yarn reserve for accommodating the compacting of said pieced places.

24. Apparatus according to claim 17, wherein the pressure elements comprise at least two structural parts presenting pressure surfaces that accept the yarn between them, of which parts, at least one is provided with a drive, to move the structural part crosswise with reference to the longitudinal axis of the yarn.

25. Apparatus according to claim 17, wherein at least one of the pressure elements is provided with an elastic friction coating.

26. Apparatus according to claim 17, wherein at least one of the pressure elements presents a shaping surface.

27. Apparatus according to claim 17, wherein the pressure elements include two plate-formed structural parts, whereof at least one is equipped with a drive mechanism.

28. Apparatus according to claim 27, wherein the plate-formed structural parts are driven in opposite movements.

29. Apparatus according to claim 17, wherein said pressure elements include two rolls that turn in the direction of the transport of the yarn, and wherein at least one of said rolls is equipped with a drive that effects an axial shift.

30. Apparatus according to claim 29, wherein a plurality of rolls are arranged one behind the other in their running direction, driven opposingly in reciprocating axial motions. pg,26

31. Apparatus according to claim 29, wherein the axially movable rolls are distributed about the periphery of a roll which is larger in diameter than said axially movable rolls.

32. Apparatus according to claim 17, wherein the pressure elements include at least one pressure surface constituted by a belt that is guided in the running direction of the yarn, about two deflection points.

33. Apparatus according to claim 17, wherein at least one of the two structural parts that receive the yarn between them with pressure surfaces is provided with a transport drive that runs at a slant to the direction of transport of the yarn.

* * * * *